US006302033B1

(12) United States Patent
Roudebush

(10) Patent No.: US 6,302,033 B1
(45) Date of Patent: Oct. 16, 2001

(54) JUVENILE TRAY

(75) Inventor: H. Richard Roudebush, Indianapolis, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/616,707

(22) Filed: Jul. 14, 2000

Related U.S. Application Data

(60) Provisional application No. 60/144,312, filed on Jul. 16, 1999.

(51) Int. Cl.[7] ..... A47B 85/00

(52) U.S. Cl. ..... 108/25; 297/188.14

(58) Field of Search ..... 108/25, 16, 44; 297/188.14; 248/311.2, 311.3, 309.1; 224/926

(56) References Cited

U.S. PATENT DOCUMENTS

| | | | |
|---|---|---|---|
| D. 376,917 | | 12/1996 | Kain . |
| 2,185,907 | | 1/1940 | Alexander . |
| 2,457,294 | | 12/1948 | Wood . |
| 3,148,636 | | 9/1964 | Bloomquist et al. . |
| 3,475,052 | | 10/1969 | Kaposi . |
| 3,690,724 | | 9/1972 | Douglas et al. . |
| 3,698,675 | | 10/1972 | Lerew et al. . |
| 4,174,866 | | 11/1979 | Rhyan . |
| 4,591,206 | | 5/1986 | Pribble . |
| 4,606,576 | | 8/1986 | Jones . |
| 4,659,099 | | 4/1987 | Malone . |
| 4,662,676 | | 5/1987 | Havelock . |
| 4,825,590 | | 5/1989 | Cullinane . |
| 4,858,869 | | 8/1989 | Stang . |
| 4,865,237 | | 9/1989 | Allen . |
| 4,928,876 | | 5/1990 | Marshall . |
| 4,972,781 | * | 11/1990 | Montgomery et al. ..... 108/25 |
| 5,010,826 | | 4/1991 | Kudlac . |
| 5,042,770 | | 8/1991 | Louthan . |
| 5,072,909 | | 12/1991 | Huang . |
| 5,279,452 | | 1/1994 | Huynh . |
| 5,361,950 | | 11/1994 | Signal et al. . |
| 5,427,292 | * | 6/1995 | Rousch ..... 108/25 X |
| 5,458,394 | | 10/1995 | Nichols et al. . |
| 5,460,102 | * | 10/1995 | Pasmanick ..... 108/25 X |
| 5,503,297 | | 4/1996 | Frankel . |
| 5,522,527 | * | 6/1996 | Tsai ..... 224/926 X |
| 5,558,391 | | 9/1996 | Chavous . |
| 5,586,800 | * | 12/1996 | Triplett ..... 108/26 X |
| 5,685,604 | | 11/1997 | Kain . |
| 5,720,226 | * | 2/1998 | Padovano ..... 108/25 |
| 5,813,579 | | 9/1998 | Hendrickson . |
| 5,865,412 | | 2/1999 | Mason . |
| 5,918,550 | | 7/1999 | Weir et al. . |
| 5,967,345 | | 10/1999 | Subotin . |
| 5,975,342 | * | 11/1999 | Bradeen et al. ..... 224/926 X |
| 6,216,605 | * | 4/2001 | Chapman ..... 108/26 |

* cited by examiner

*Primary Examiner*—Jose V. Chen

(57) ABSTRACT

A container holder includes a container receiver formed to include a top surface and a mounting flange coupled to the container receiver and adapted to be coupled to a juvenile seat to mount the container receiver thereon. The holder further includes a receptacle depending from the top surface. The receptacle includes a bottom wall, a pair of end walls, and a pair of side walls. Each side wall includes a pair of straight sections and a concave curved section therebetween. The concave curved sections are spaced apart and arranged to receive a round container therein. The straight sections of the side walls and the end walls cooperate to receive a rectangular container therein.

5 Claims, 3 Drawing Sheets

JUVENILE TRAY

This application claims priority under 35 U.S.C. 119(e) to U.S. Provisional Application Serial No. 60/144,312, filed Jul. 16, 1999, which is expressly incorporated by reference herein.

BACKGROUND AND SUMMARY OF THE INVENTION

This invention relates to a tray, and particularly to a tray to be mounted on the frame of ajuvenile stroller or high chair. More particularly, this invention relates to a tray having a top surface configured to receive various items therein.

According to the present invention, a juvenile tray includes a flat top surface configured to provide a shelf and an opening into a first receptacle depending from the flat top surface. The first receptacle includes a bottom wall, a pair of end walls, and a pair of side walls. Each side wall includes a pair of straight sections and a concave curved section therebetween.

In preferred embodiments, the concave curved sections are spaced apart and arranged to provide a space sized to receive a round cup or can therein. The straight sections of the side walls and the end walls cooperate to provide a space sized to receive a rectangular "juice box." Thus, the first receptacle is adapted to receive both round and rectangular objects therein.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
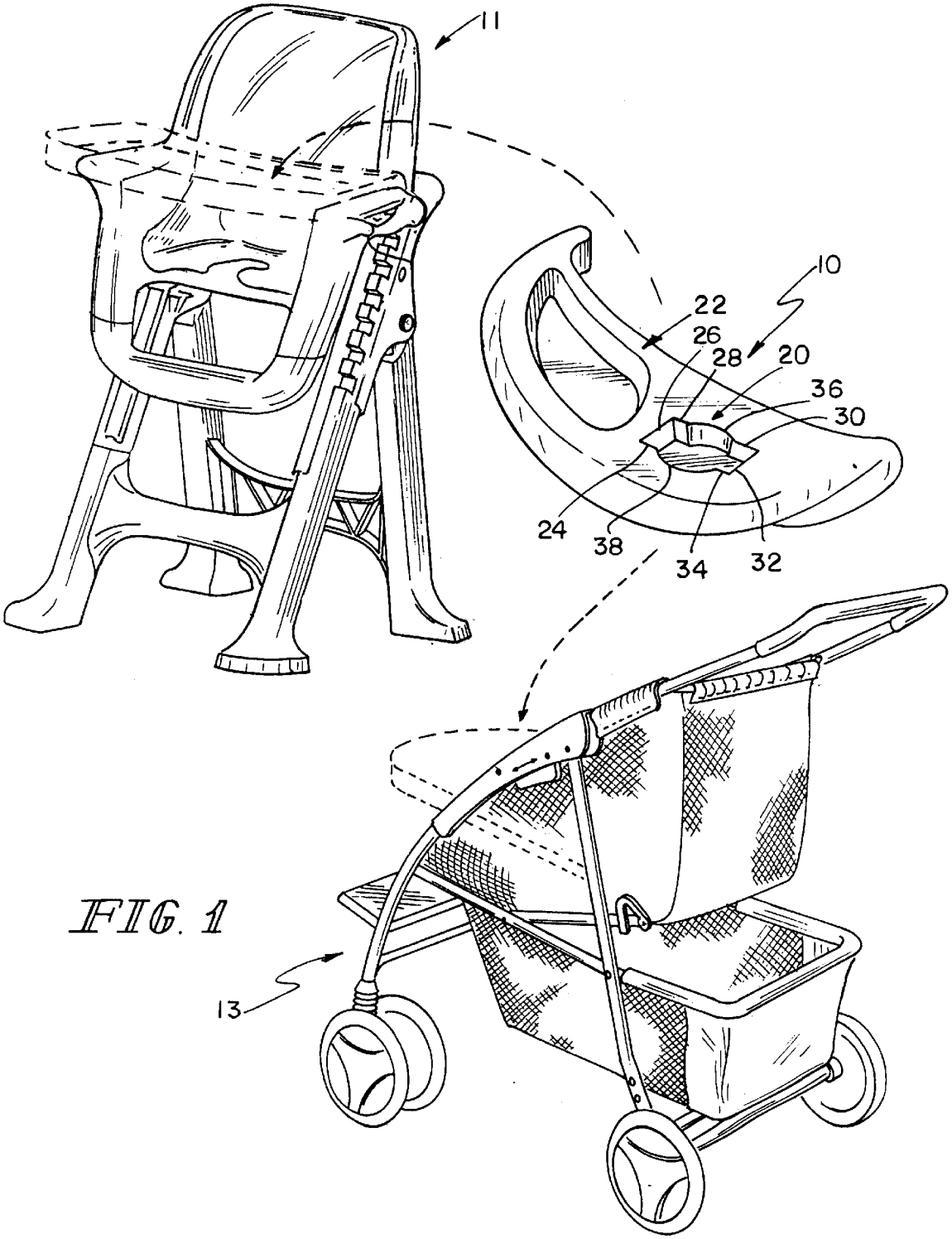
FIG. 1 is a perspective view of a juvenile tray in accordance with the present invention showing that such tray is adapted to be mounted on a high chair or stroller.

A tray 10 is formed to include two receptacles 20, 22 as shown in FIG. 1. Tray 10 is adapted to be mounted on either a high chair 11, stroller 13, or other support (not shown). The first receptacle 20 is formed to receive both round and rectangular containers (not shown) so as to maximize the stability of those containers in first receptacle 20.

Tray 10 includes a left end 12, a right end 14, and an intermediate portion 16 extending between left end 12 and right end 14. Intermediate portion 16 is formed to include a top surface 18 extending between ends 12 and 14 as shown in FIG. 1. Tray 10 is formed to include a first receptacle 20 having an opening in top surface 18 and a second receptacle 22 having another opening in top surface 18 as shown in FIG. 1.

The perimeter edge of top opening 20 is configured to include several straight sections 24, 26, 28, 30, 32, and 34 arranged as shown in FIG. 1 to accommodate a juice box or other rectangle-shaped item therein. The perimeter of top opening 20 is also formed to include opposing spaced-apart curved sections 36 and 38 arranged as shown in FIG. 1 to facilitate insertion of a round can, cup, or other item into the receptacle 20 formed in the stroller tray 10.

Figure 2:
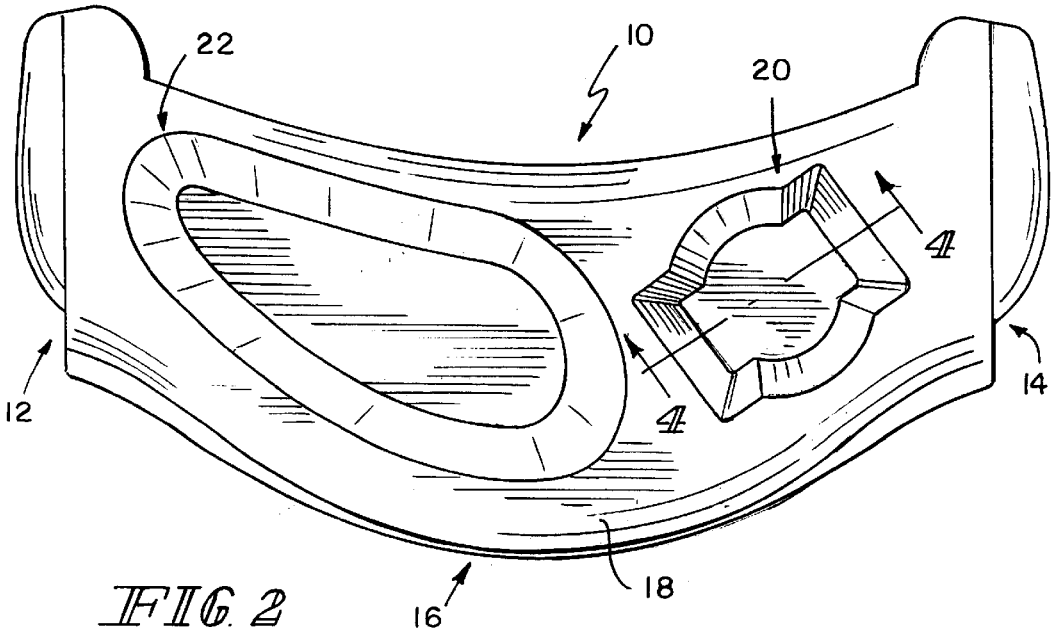
FIG. 2 is a top plan view of a juvenile tray in accordance with the present invention showing two receptacles formed in a top surface of the tray.
Figure 3:
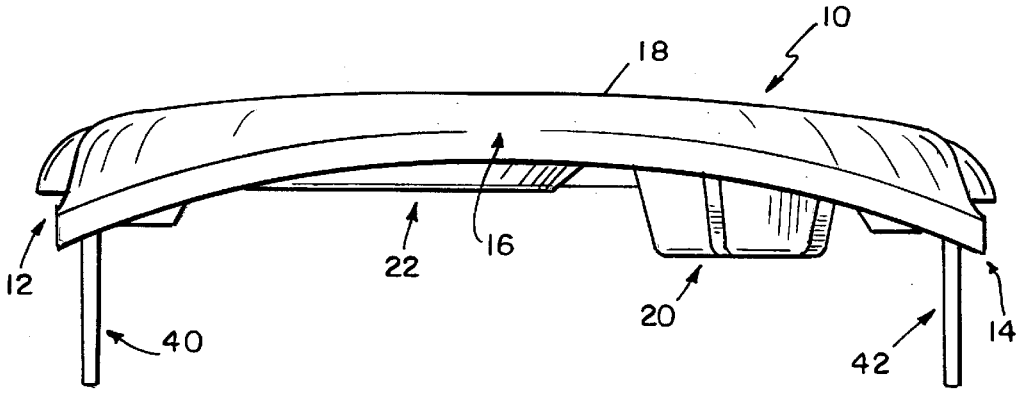
FIG. 3 is a front elevation of the tray of FIG. 1 showing portions of the two tray receptacles extending downwardly from the top surface of the tray and also showing two mounting flanges fixed to opposite ends of the top surface of the tray and positioned to extend downwardly from the top surface of the tray.
Figure 4:
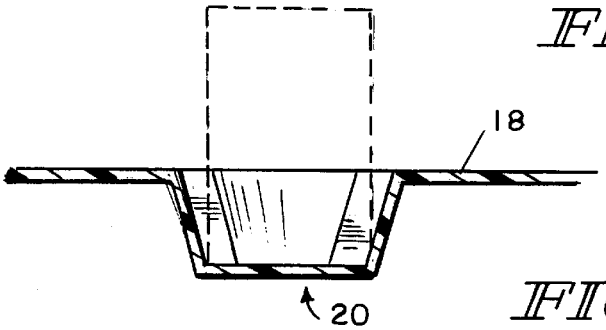
FIG. 4 is a sectional view taken along line 4—4 of FIG. 2 showing a first receptacle and a "juice box" (in phantom) positioned to lie in a rectangle-shaped portion of the first receptacle.
Figure 5:
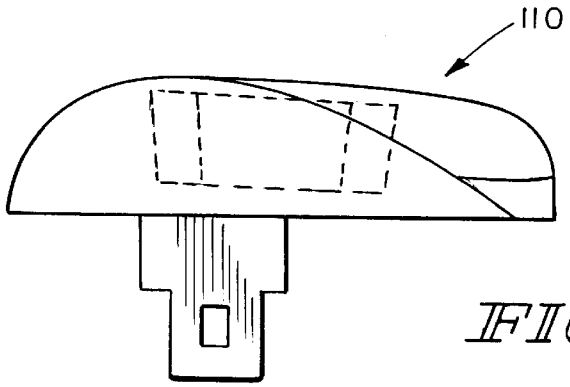
FIG. 5 is a left-side end elevation of the tray shown in FIGS. 2 and 3 showing mounting flanges in more detail.

First receptacle 20 includes a bottom wall 39 and side walls extending upwardly from bottom walls 39 to each section 24, 26, 28, 30, 32, 34, 36, and 38 of the perimeter edge as shown, for example, in FIGS. 1 and 2. The side walls are oriented to be nearly vertical (i.e., perpendicular to bottom wall 39); however, they can be inclined at a slight angle at the option of the maker.

The perimeter edge of second receptacle 22 is selected to provide an article-receiving space in second receptacle 22. It is within the scope of this disclosure to configure the perimeter edge of second receptacle 22 along the lines as shown for first receptacle 20.

Mounting flanges 40 and 42 are provided to facilitate coupling of tray 10 to the frame of any suitable juvenile seat including a juvenile vehicle seat, stroller, high chair, or other device. Some of those options are shown in FIG. 1.

A tray 110 in accordance with a second embodiment of the invention is shown in FIGS. 5–8. Tray 110 is also adapted to be mounted to a support such as a high chair, stroller, or other juvenile seat.

Figure 6:
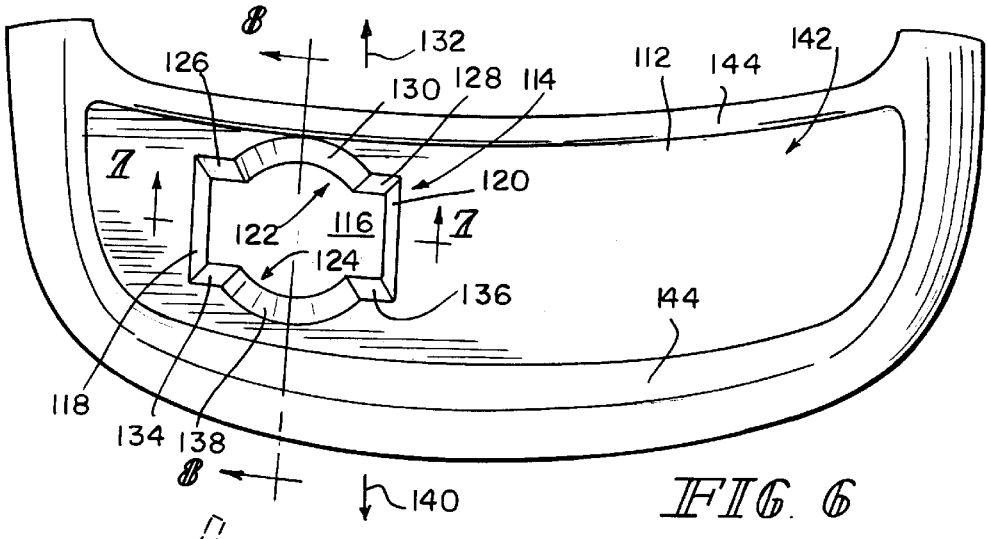
FIG. 6 is a top plan view of another embodiment of ajuvenile tray in accordance with the present invention showing a first receptacle formed to have an opening in a floor of a second receptacle.

Tray 110 includes a flat top surface 112 configured to provide a shelf and a first receptacle 114 having an opening in flat top surface 112 as shown best in FIG. 6. First receptacle 114 includes a bottom wall 116, first and second straight end walls 118, 120, and first and second side walls 122, 124. Each of end walls 118, 120 and side walls 122, 124 is arranged to be nearly perpendicular to bottom wall 116.

Each of first and second side walls 122, 124 is arranged to interconnect first and second straight end walls 118, 120 as shown, for example, in FIG. 6. First side wall 122 is formed to include a first straight section 126 adjacent to first straight end wall 118, a second straight section 128 adjacent to second straight end wall 120, and a concave curved section 130 bowed outwardly in a first direction 132 and arranged to interconnect first and second straight sections 126, 128. Second side wall 124 is formed to include a first straight section 134 adjacent to first straight end wall 118, a second straight section 136 adjacent to second straight end wall 120, and a concave curved section 138 bowed outwardly in an opposite second direction 140 and arranged to interconnect first and second straight sections 134, 136.

As shown best in FIG. 6, the concave curved sections 130, 138 of first and second side walls 122, 124 cooperate with bottom wall 116 to define round-receiver means for receiving a container (shown in phantom in FIG. 8) having a circular cross section. The first and second straight end walls 118, 120 cooperate with bottom wall 116 and the straight sections 126, 128, 134, and 136 of the first and second side walls 122, 124 to define rectangle-receiver means for receiving a "juice box" container (shown in phantom in FIG. 7) having a rectangular cross section. Flat top surface 112 is formed to include an opening into each of the round-receiver means and the rectangle-receiver means as shown, for example, in FIG. 6.

Figure 7:
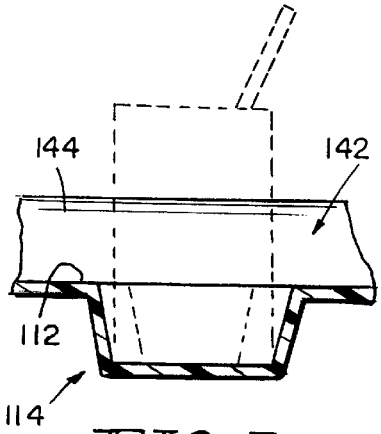
FIG. 7 is a sectional view taken along line 7—7 of FIG. 6 showing a juicer box (in phantom) positioned to lie in a rectangle-shaped portion of the first receptacle.
Figure 8:
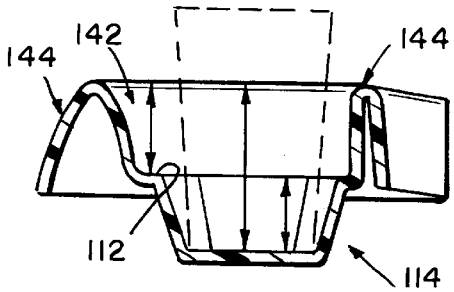
FIG. 8 is a sectional view taken along line 8—8 of FIG. 6 showing a cup (in phantom) positioned to lie in a circle-shaped section of the first receptacle.

Tray 110 further includes a second receptacle 142 having a bottom wall defined by flat top surface 112 as shown, for example, in FIGS. 6–8. Second receptacle 142 includes a perimeter side wall 144 coupled to flat top surface 112 and arranged to extend upwardly away from flat top surface 112. First receptacle 114 is arranged to extend downwardly below flat top surface 112.

Although the invention has been described in detail with reference to certain preferred embodiments, variations and modifications exist within the scope and spirit of the invention as described and defined in the following claims.

What is claimed is:

1. A monolithic juvenile tray comprising a flat top surface configured to provide a shelf and a first receptacle including an opening in the shelf, a planar bottom wall below the shelf, first and second straight end walls positioned to interconnect the bottom wall interconnecting in spaced-apart, opposed relation to one another, and first and second side walls the bottom wall in spaced-apart, opposed relation to one another, each side wall being arranged to interconnect the first and second straight end walls and formed to include a first straight section adjacent to the first straight end wall, a second straight section adjacent to the second straight end wall, and a concave curved section interconnecting the first and second straight sections, the concave curved section of the first side wall bowing outwardly in a first direction, the concave curved section of the second side wall bowing outwardly in a second direction opposite to the first direction, the concave curved sections of the first and second side walls cooperating to define round- receiver means for receiving a container having a circular cross section therebetween, the first and second straight end walls cooperating with the first and second straight sections of the first and second side walls to define rectangle-receiver means for receiving a container having a rectangular cross section therebetween, the flat top surface being formed to include an opening into each of the round-receiver means and the rectangle-receiver means, the planar bottom wall providing a container-receiving floor in each of the round-receiver means and the rectangle-receiver means.

2. A monolithic juvenile tray comprising a flat top surface configured to provide a shelf, a first receptacle including an opening in the shelf, a planar bottom wall, first and second straight end walls positioned to interconnect the bottom wall and the shelf and in spaced-apart, opposed relation to one another, and first and second side walls positioned to the bottom wall and the shelf and in spaced-apart, opposed relation to one another, each side wall being arranged to interconnect the first and second straight end walls and formed to include a first straight section adjacent to the first straight end wall, a second straight section adjacent to the second straight end wall, and a concave curved section interconnecting the first and second straight sections, the concave curved section of the first side wall bowing outwardly in a first direction, the concave curved section of the second side wall bowing outwardly in a second direction opposite to the first direction, the concave curved sections of the first and second side walls cooperating to define round- receiver means for receiving a container having a circular cross section therebetween, the first and second straight end walls cooperating with the first and second straight sections of the first and second side walls to define rectangle-receiver means for receiving a container having a rectangular cross section therebetween, the opening providing an entrance into each of the round-receiver means and the rectangle-receiver means, and a second receptacle, wherein the first receptacle extends downwardly below the flat top surface and the second receptacle includes a bottom wall defined by the flat top surface and a perimeter side wall coupled to the bottom wall and arranged to extend upwardly away from the flat top surface.

3. A monolithic container holder comprising a container receiver formed to include a top surface, a mounting flange coupled to the container top surface and adapted to be coupled to a juvenile seat to mount the container receiver thereon, and a first receptacle including an opening in the top surface, a planar bottom wall, first and second straight end walls positioned to interconnect the bottom wall and top surface and in spaced-apart, opposed relation to one another, and first and second side walls positioned to interconnect the bottom wall and top surface and in spaced-apart, opposed relation to one another, each side wall being arranged to interconnect the first and second straight end walls and formed to include a first straight section adjacent to the first straight end wall, a second straight section adjacent to the second straight end wall, and a concave curved section interconnecting the first and second straight sections, the concave curved section of the first side wall bowing outwardly in a first direction, the concave curved section of the second side wall bowing outwardly in a second direction opposite to the first direction, the concave curved sections of the first and second side walls cooperating to define round-receiver means for receiving a container having a circular cross section therebetween, the first and second straight end walls cooperating with the first and second straight sections of the first and second side walls to define rectangle-receiver means for receiving a container having a rectangular cross section therebetween, the top surface opening providing an entry into each of the round-receiver means and the rectangle-receiver means, the planar bottom wall providing a container-receiving floor in each of the round-receiver means and the rectangle-receiver means.

4. A monolithic container holder comprising a container receiver formed to include a top surface, a mounting flange coupled to the container receiver top surface and adapted to be coupled to a juvenile seat to mount the container receiver thereon, and a receptacle depending from the top surface, the receptacle including a bottom wall, a pair of end walls having a height extending between the top surface and the bottom planar wall, and a pair of side walls, each side wall including a pair of straight sections and a concave curved section therebetween, each of the straight and concave curved sections having a height equivalent to the height of the end walls, the concave curved sections being spaced apart and arranged to receive a round container therein, the straight sections of the side walls and the end walls being spaced apart and arranged to receive a rectangular container therein.

5. A monolithic juvenile tray comprising a flat top surface configured to provide a shelf and a first receptacle including a planar bottom wall, first and second straight end walls positioned to interconnect the bottom wall and the flat top surface and in spaced-apart, opposed relation to one another, and first and second side walls positioned to interconnect the bottom wall and the flat top surface and in spaced-apart, opposed relation to one another, each side wall being arranged to interconnect the first and second straight end walls and formed to include a first straight section adjacent to the first straight end wall, a second straight section adjacent to the second straight end wall, and a concave curved section interconnecting the first and second straight sections, the concave curved section of the first side wall bowing outwardly in a first direction, the concave curved section of the second side wall bowing outwardly in a second direction opposite to the first direction, the concave curved sections of the first and second side walls cooperating to define a round-receiver for receiving a container having a circular cross section therebetween, the first and second straight end walls cooperating with the first and second straight sections of the first and second side walls to define a rectangle-receiver for receiving a container having a rectangular cross section therebetween, each of the round-receiver and the rectangle-receiver being positioned to lie in an opening formed in the flat top surface, the planar bottom wall providing a container-receiving floor in each of the round-receiver means and the rectangle-receiver means.

* * * * *